US006672825B1

(12) United States Patent
Tarelin et al.

(10) Patent No.: US 6,672,825 B1
(45) Date of Patent: Jan. 6, 2004

(54) METHOD AND APPARATUS FOR INCREASING POWER GENERATED BY A STEAM TURBINE BY CONTROLLING THE ELECTRIC CHARGE IN STEAM EXITING THE STEAM TURBINE

(75) Inventors: Anatoly O. Tarelin, Kharvid (UA); Volodymyr P. Skliarov, Kharkiv Oblast (UA)

(73) Assignee: Electric Power Research Institute, Inc., Palo Alto, CA (US)

( * ) Notice: Subject to any disclaimer, the term of this patent is extended or adjusted under 35 U.S.C. 154(b) by 0 days.

(21) Appl. No.: 09/979,255

(22) PCT Filed: Sep. 14, 1999

(86) PCT No.: PCT/UA99/00019

§ 371 (c)(1),
(2), (4) Date: May 8, 2002

(87) PCT Pub. No.: WO00/71857

PCT Pub. Date: Nov. 30, 2000

(30) Foreign Application Priority Data

May 21, 1999 (UA) ..... 99052833

(51) Int. Cl.[7] ..... F01D 11/00

(52) U.S. Cl. ..... 415/1; 415/176; 60/685

(58) Field of Search ..... 415/1, 176; 60/685, 60/686, 648, 641.2, 687

(56) References Cited

U.S. PATENT DOCUMENTS

| | | | |
|---|---|---|---|
| 5,507,145 | A | 4/1996 | Kürten et al. |
| 5,699,666 | A | 12/1997 | Kürten et al. |
| 5,735,125 | A | 4/1998 | Tarelin et al. |
| 5,992,152 | A | 11/1999 | Weres et al. |

FOREIGN PATENT DOCUMENTS

| | | |
|---|---|---|
| DE | 26 12 824 | 9/1977 |
| DE | 32 33 473 A1 | 3/1984 |
| SU | 315767 | 10/1971 |
| SU | 358530 | 11/1972 |
| SU | 1740702 A1 | 6/1992 |
| WO | PCT/UA 99/00019 | 9/1999 |

*Primary Examiner*—Edward K. Look
*Assistant Examiner*—J. M. McAleenan
(74) *Attorney, Agent, or Firm*—Pennie & Edmonds LLP

(57) ABSTRACT

A method of increasing the power generated by a steam turbine includes the step of receiving, at a steam turbine final stage, a steam byproduct with an electrically charged component. An electric field is created immediately proximate to the steam turbine final stage to substantially eliminate the electrically charged component from the steam byproduct and thereby reduce turbulence associated with the steam byproduct.

18 Claims, 3 Drawing Sheets

METHOD AND APPARATUS FOR INCREASING POWER GENERATED BY A STEAM TURBINE BY CONTROLLING THE ELECTRIC CHARGE IN STEAM EXITING THE STEAM TURBINE

BRIEF DESCRIPTION OF THE INVENTION

This invention relates to a method and apparatus for controlling the magnitude of the electric charge downstream of the last stage of a steam turbine and thereby decreasing the harmful effect of the electric charge on steam turbine operation, resulting in an increase in the power generated by the steam turbine.

BACKGROUND OF THE INVENTION

The appearance of moisture in the steam flow of a steam turbine is accompanied by the creation of electric charges on water droplets. Depending on the feed water chemical composition and the material of the blades and vanes, the sign and magnitude of charges on the droplets may be subject to change. As a rule, the water droplets in the turbine flow paths are charged positively. Charges on the droplets are formed mainly due to separation of the double electric layer when droplets break off from the turbine blades and other metal surfaces. The charged droplets, in being driven under the effect of an inhomogeneous electric field toward the hood's grounded surfaces, create an additional turbulence and resistance to the steam flow, thereby increasing the power losses to result in a decrease of the turbine unit efficiency. If the droplets carry away a positive charge, the turbine blades and hence the rotor acquire a negative charge. The presence of a negative potential on the turbine rotor may cause erosion of bearings, unless special grounding is provided. Separation of charges when the droplets break off from the blades may be accompanied by the dissociation of water molecules due to the increasing electric field and by the appearance of hydrogen. If the liberated hydrogen reacts with the metal, hydrides may appear, which make the metal brittle. Besides, the electric discharges appearing between the charged droplets and the grounded metal surfaces lead to metal destruction. All this in turn causes increased erosion of the internal elements and the hood surfaces.

The efficient operation of a turbine-generator set depends essentially on the steam moisture content in the last stages of a turbine. Typically, an increase of moisture content by 1% causes a drop in the turbine stage efficiency by approximately 1%. At the same time, an increase of the moisture content causes increased erosion of the turbine blades and vanes as well as of the surfaces of the turbine exhaust hood elements. During operation of a turbine, electric charges are formed in the moving steam flow. These charges appear on liquid water droplets, whereas dry steam is substantially without electrification. These processes are described in U.S. Pat. No. 5,735,125, which is incorporated by reference and in U.S. patent application Ser. No. 09/037,902 which is also incorporated by reference.

The presence of charged droplets in the steam flow causes volume condensation of saturated vapor as in the well-known Wilson Chamber used to visualize the tracks of subatomic particles. The process has an avalanche character since volume condensation contributes to an increase of the steam moisture content, which in turn is accompanied by an increase of the volume charges.

The process of formation of electric charges depends on a number of physical factors, including, flow velocity, moisture content, the surface condition of the turbine blades and the turbine flow guides, as well as on the intensity and the polarity of the electric field. Downstream of the last turbine stage, the steam flow possesses significant kinetic energy. In the presence of water droplets in the steam flow, the, turbine acts as an electrostatic aerosol generator. Electrostatic aerosol generation may reach 4% and more of the mechanical power. Part of the steam flow kinetic energy is spent on creating an electric field which is especially powerful near the last stage. This field is directed in opposition to the steam flow, resulting in braking of the charged droplets. In addition, the charge density and the electric field intensity both in the axial and in the radial directions are highly irregular. Such an electric field may create electric charges adjacent to the grounded parts of the steam flow guides. The electric field drives the charged droplets crosswise to the flow towards the grounded surfaces of the exhaust hood, thereby creating additional resistance to the flow. All this leads to intensification of the turbulent flow and an increase of losses in the hood, resulting in a reduction of the generating unit's energy conversion efficiency.

In U.S. patent application Ser. No. 09/037,902 it has been suggested to effect the wet steam flow charge and thereby increase power output by changing the feed water chemical composition as well as by selecting the material of the blades and flow guides working surfaces. In a number of cases this method may prove to be fairly convenient since it allows the steam flow charge over the turbine's entire steam flow path without using additional devices. However, due to different quality of water used at power plants, this method may not be used at all times.

The invention disclosed herein is distinct from that disclosed in U.S. Pat. No. 5,735,125 in structure, operation and mechanism. In U.S. Pat. No. 5,735,125 (1) the active electrodes are installed above the condenser tube bundles, (2) the active electrodes alternate with grounded counterelectrodes, (3) a voltage of the same polarity as the sign of the electric charge present in the steam is applied to the active electrodes, (4) the voltage is adjusted as high as can be maintained without causing arcing or sparking between electrodes, and (5) the process is believed to increase power output by decreasing turbulence in the steam flow at the entrance to the condenser and increasing the density of condensation nuclei. In the invention disclosed herein (1) the active electrodes are located close to the last stage turbine wheel, (2) no counterelectrodes are provided, (3) the voltage applied to the counterelectrodes has polarity opposite to the sign of the charge present in the steam flowing out of the turbine, (4) the voltage is adjusted to give approximately zero net charge density in the flow downstream of the electrodes, and (5) the beneficial effects flow from eliminating electric charge from the flow whereby turbulence in the exhaust hood is decreased, increasing power output.

SUMMARY OF THE INVENTION

The method of the invention includes the step of receiving, at a steam turbine final stage, a steam byproduct with an electrically charged component. An electric field is created immediately proximate to the steam turbine final stage to substantially eliminate the electrically charged component from the steam byproduct and thereby reduce turbulence associated with the steam byproduct.

The apparatus of the invention is a steam turbine with a final stage turbine wheel to eject a steam byproduct with an electrically charged component A set of active electrodes create an electric field immediately proximate to the final stage turbine wheel. The electric field operates to substantially eliminate the electrically charged component from the steam byproduct and thereby reduce turbulence associated with the steam byproduct.

The invention reduces the turbulence and the backpressure downstream the last turbine stage, which reduces losses due to moisture content, thereby increasing power output, and minimizing erosion of the structural elements and surface of the exhaust hood in steam turbines.

BRIEF DESCRIPTION OF THE DRAWINGS

For a better understanding of the invention, reference should be made to the following detailed description taken in conjunction with the accompanying drawings, in which.

Like reference numerals refer to corresponding parts throughout the drawings.

DETAILED DESCRIPTION OF THE INVENTION

Figure 1:
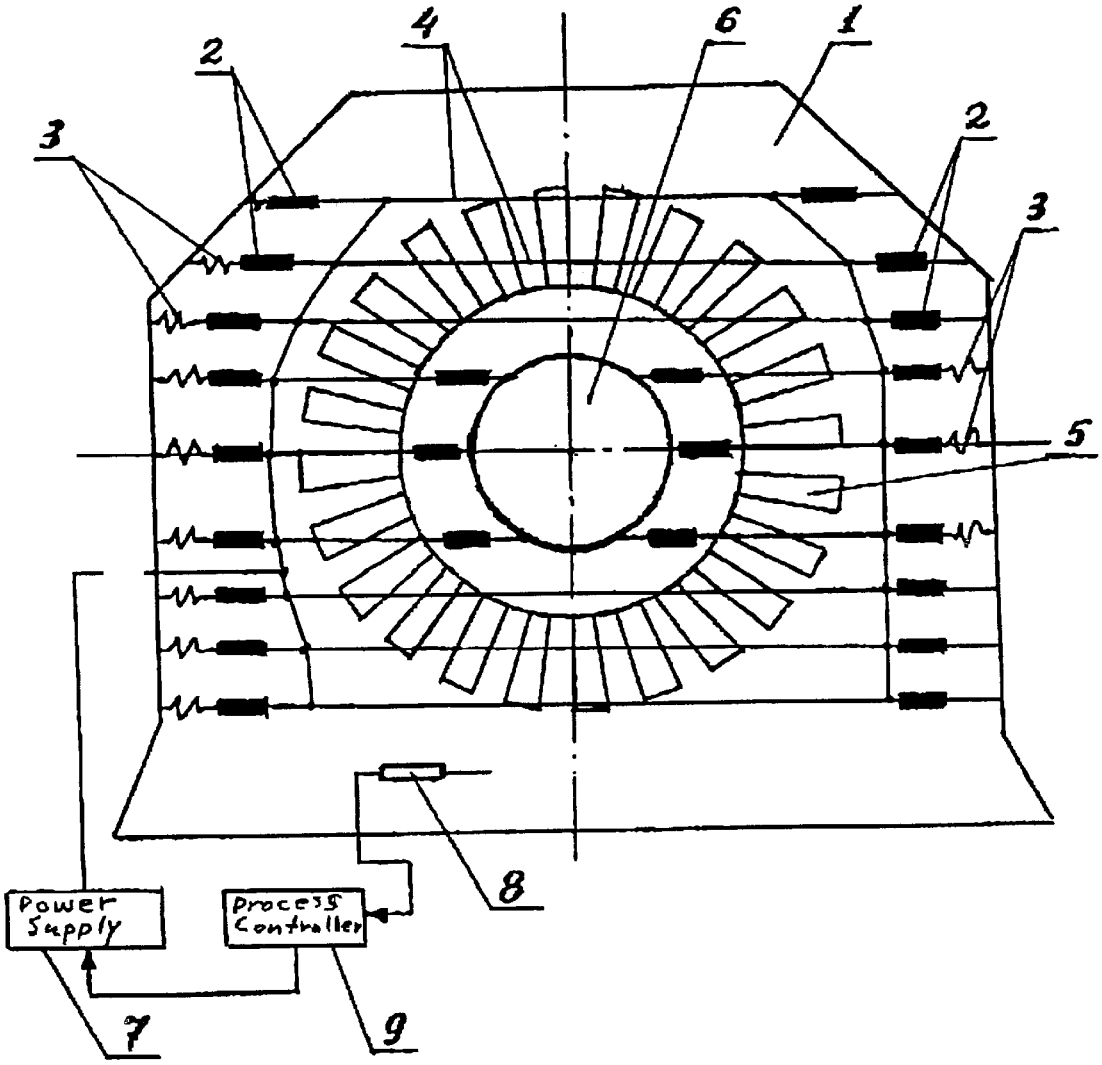
FIG. 1 illustrates an apparatus, in accordance with an embodiment of the invention, to reduce electric charge in steam exiting a steam turbine.

FIG. 1 illustrates an apparatus in accordance with an embodiment of the invention. The figure shows a housing 1 for an exhaust hood of a steam turbine. High-voltage suspension insulators 2 are attached to the housing 1. Vibration damping elements (e.g., springs) 3 are preferably used for connecting one side of an active electrode 4 to the housing 1. Thus, as shown in FIG. 1, an active electrode 4 is positioned between high-voltage suspension insulators 2, with one high-voltage suspension insulator being attached to the housing 1, and a second high-voltage suspension insulator being attached to the housing 1 through a vibration damping element 3.

As shown in FIG. 1, a set of active electrodes 4 is positioned immediately adjacent to a final stage turbine wheel 5. The final stage turbine wheel 5 has an associated turbine bearing housing 6.

FIG. 1 shows that the set of active electrodes is electrically connected to a high-voltage power supply 7. Also shown in FIG. 1 is a charge probe 8, which generates a measured voltage. The measured voltage is processed by a controller 9, which alters a direct current voltage output from the direct current power supply 7 in response to the measured voltage, as discussed below.

Figure 2:
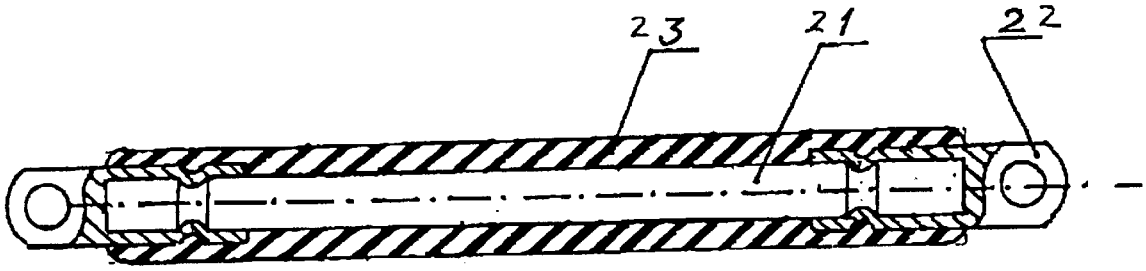
FIG. 2 illustrates a high-voltage current lead that may be used in accordance with an embodiment of the invention.

FIG. 2 illustrates a high-voltage suspension insulator 2 that may be used in accordance with an embodiment of the invention. As shown in FIG. 2, in one embodiment of the invention, the high-voltage suspension insulator 2 includes a fiberglass rod 21, which preferably includes machined circumferential grooves for crimping. At either end of the fiberglass rod 21 is a crimped metal end cap 22. Silicone rubber insulation 23 surrounds the rod 21.

Figure 3:
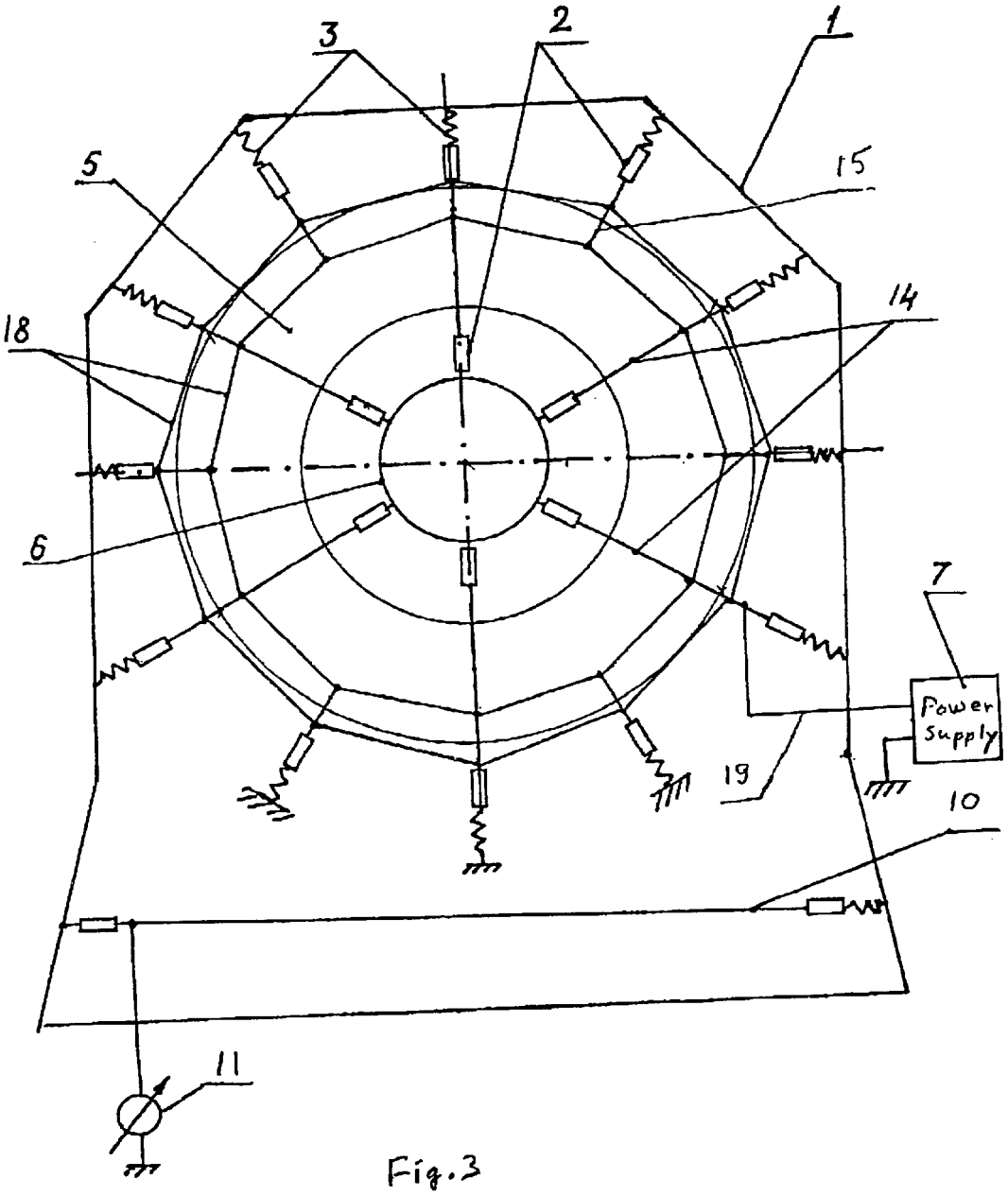
FIG. 3 illustrates an apparatus, in accordance with an alternate embodiment of the invention, to reduce electric charge in steam exiting a steam turbine.

FIG. 3 illustrates an alternate configuration for the set of active electrodes. The configuration of FIG. 3 includes full-length radial electrode elements 14, half-length radial electrode elements 15, and circumferential electrode elements 18. The apparatus of FIG. 3 also includes a long wire charge probe 10 and a microammeter 11. The operation of the apparatus of FIG. 3 is discussed below.

The following terms are used while discussing the invention. First, reference is made to "active electrodes". The active electrodes 4 are electrodes on which a preselected potential with respect to ground is maintained. An "Apparent charge density" is a density of charges in wet steam detected by the electric probe 8. An "Electric probe" 8 is an isolated pin or a conductor of any other shape disposed at the measurement point in the working medium.

A set of active electrodes 4, such as shown in, FIGS. 1 and 3, is sometimes referred to as a "collector". A "limit voltage" is a voltage at which an independent electrical discharge is initiated in a working medium. A "working medium" is the steam flow in the zones where the active collector electrodes are located.

As shown in the figures, the device for controlling the steam flow charge comprises several active electrodes (collectors) 4 fitted on high-voltage insulators 2 adjacent to the turbine blades 5, an adjustable high-voltage power supply source 7, and an electric probe 8.

In operating the device, the electrodes 4 are supplied from the adjustable high-voltage power supply 7 with voltage whose polarity is opposite to the charge of the steam flow. The magnitude of the voltage being applied depends on the density of electric charges in the steam flow. The application of an electric field whose polarity is opposite to the charge of the steam flow mitigates the braking effect of the charged droplets and changes the conditions of charge formation, thereby leading to reduction of the flow charge density and rapid removal of charge from the flow.

The method and device being taught have been tested at a 50 MW turbine unit of the type BK-SO operated at the District Power Generating Plant-2 "Eskhuar" in Ukraine. The tests have demonstrated the high efficiency of the method being disclosed.

Principles of Operation

As a rule, the steam flow downstream of the last stage of a condensing steam turbine has moisture content of about 10%. The greater part of the moisture is formed in the flow due to dispersion of the water film when it separates from the surface of the turbine blades. In separating from the metal surface, the water droplets carry away part of the double electrical layer. This layer appears always when a metal comes into contact with an electrolyte. Due to the presence of chemical additives in the feed water, the condensed water is a weak electrolyte. Depending on the water chemical composition and the blading material, the droplets may be charged to different magnitudes. If a droplet of radius R having the charge Q moves away from the blade surface, its electric capacitance C falls. But since the charge Q remains constant, the voltage $U=Q/C$ increases. As a result, at some distance from the blade surface the droplet voltage may achieve limit values. The electric fields of individual charged droplets become integrated into the total flow electric field. As a rule, the intensity of such a field builds up rapidly to its limit value. During field tests in a 50 MW turbine unit, the electric field intensity near the turbine last stage was equal to about $2\times10^5$ V/m, the apparent flow charge density being equal to about $10^{-2}$ C/kg. Such field intensity may generate a corona discharge from the water droplet causing it to decay into a multitude of fine droplets, and this process may cause dissociation of water molecules. Experiments carried out in Ukraine in a 50 MW turbine unit and the experiment carried out in a 800 MW turbine unit that were described in U.S. patent application Ser. No. 09/037,902 have demonstrated that the distribution of charges in the steam flow downstream the last turbine stages over the radius of the rotor wheel matches the moisture distribution pattern. About half of the blade length from its root is located in the zone of a weakly charged flow and it is only the peripheral part of the blade that operates in the zone with a large density of electric charge. Since the charges are focused in a limited area occupying the space near the perimeter of the rotor wheel, the problem of controlling the flow charge becomes significantly easier. The problem consists in ensuring the possibility of decreasing the flow charge density to a minimal value or even to charge the flow to the reverse polarity. To reduce the flow charge density it is necessary to neutralize the charged water droplets. To this end electric charge is removed from the wet steam flow and charged particles of the opposite charge are emitted into the flow. The level of compensation and the residual flow charge density may vary depending on how the process is operated.

In a number of technological areas the problem of neutralizing charged flows of gases, fluids and aerosols is being solved. However, the prior art does not appear to show or suggest methods and means of neutralizing the volume charge of a wet steam flow in turbines. A wet steam flow has a number of features preventing the usage of prior art devices for neutralizing charges. Firstly, the flow in the wet steam zone has a high velocity (within 2002 to 500 m/s); secondly, the flow has a large charge density up to $10^{-3}$ to $10^{-2}$ C/kg, this being $10^2$ to $10^3$ times more than the density of charge in a thundercloud. Besides, the problem cannot be reduced simply to neutralizing the flow, but requires elimination of harmful effects generated by the volume charge. To neutralize the volume charge downstream of the turbine last stage a collector is installed near the rotor wheel at a distance of 50 to 250 mm away from it. Such a collector comprises a group of electrodes 4 fitted on insulators 2 and connected to an adjustable high-voltage power supply source.

If, for instance, the flow downstream of the turbine stage is charged positively, then negative voltage is applied to the collector electrodes. When the charged droplets enter the collector electric field they are attracted and deposited on the electrodes, releasing thereto their charges. After this, corona discharges are initiated from the water droplets attracted to the electrodes. The charges are caused by the volume charge field and continuous ejecting of fine water droplets into the flow, which bear the same charge polarity as the electrode potential. The field intensity near these droplets is extremely high due to their small radii. Under the effect of the electric field, droplets ejected from the electrodes and having for instance a negative charge, start merging with the flow droplets charged positively and not attracted by the electrodes. As a result of the combined action of these two phenomena, the net flow charge drops. The voltage applied to the collector electrodes is significantly lower than the corona discharge glow voltage in the neutral flow and the discharge is sustained mainly by the field of the flow's own volume charge. Thus, when no charges are present in the steam flow, the intensity of the electric field created by the collector electrodes turns out to be insufficient to sustain an independent electric discharge. In the event charged droplets appear in the steam flow, the intensity of the electric field between these droplets and the collector electrodes turns out to be greater than the breakdown value and the process described above is initiated. Such a neutralizing mechanism is possible only in a wet steam flow.

Applying a large voltage to the electrodes creates an electric field downstream of the last stage of the turbine, helping to prevent the formation of charges on water droplets and the increase of charge density in the steam flow. The electric field is created close to the surface of the rotor wheel of the turbine last stage so that the lines of force of the field are perpendicular to the surface of the last stage rotor wheel and in opposition to the lines of force of the electric field created by the electric charge in the steam flow.

Since the device for controlling the wet steam flow charge is located in the exhaust hood in close proximity to the rotor wheel, its components have to meet a number of specific requirements:

- all components have to possess minimal windage to prevent deterioration of the flow gas dynamic characteristics;
- the materials of the metal structures have to possess high erosion and corrosion resistance, as well as extreme durability under strong vibration conditions; and
- the materials used for insulators and current leads must possess high erosion and tracking resistance and a low dielectric lossestangent tgδ.

The latter requirement is due to the fact that a high-frequency noisy electric field is created in the charged water-and-steam flow. This field is capable of causing strong heating and even thermal destruction of dielectrics, especially polymer materials with a high tgδ. The requirement to high tracking resistance is due to the fact that voltage up to 30 kV may be induced when the turbine operates with insulated electrodes installed close to the rotor wheel. Such voltage may cause a surface breakdown of a wet insulator. In case tracks appear such an insulator may become damaged in time. The insulators used in the device disclosed maintain their insulation properties in the working medium due to their small surface area and the materials used. Silicone rubber used for the insulators possesses high tracking resistance and good dielectric properties. Due to its small surface area, the insulator is kept dry by being heated with leakage currents and evaporation of the water droplets formed on its surface under the effect of the flow electric field. The components installed close to the turbine rotor wheel are affected by the pulsed steam flow which may cause a strong vibration. This fact has to be taken into account when selecting the materials for the active collector electrodes.

Returning to FIG. 1, each active electrode 4 is fitted on two suspension insulators 2. Preferably, one of the insulators 2 is secured directly to the wall of the exhaust hood 1 and the other is fitted on the shock absorbing element 3 that may be, for instance, a spring. In one implementation of the invention, the active electrodes 4 are positioned parallel to one another with a pitch of 100 to 250 mm at the distance of 50 to 300 mm from the plane 5 of the turbine rotor wheel. All the collector electrodes are electrically interconnected and connected to the adjustable high-voltage source 7. To monitor the flow charge the electric probe 8 is installed in the turbine exhaust hood. The electric probe 8 output signal may be provided to the process controller 9 which controls the high-voltage source 7. The electric probe 8 for measuring the charge density in the steam flow may be an insulated pin or any other conductor fitted on an insulator. To determine the flow charge, a microammeter 11 (see FIG. 3) is connected between the electric probe lead and the electric ground; for example, the outer wall of the exhaust hood.

An insulated probe exposed to the charged steam flow and connected to electrical ground through a microammeter or process controller (for example, the probe depicted in FIG. 1 of U.S. patent application Ser. No. 09/037,902) will pick up a current that is indicative of the charge density in the flowing wet steam that the probe is exposed to. The high voltage power supply 7 that powers the electrodes is controlled by the process controller 9 to provide the voltage to the electrodes 4, which causes the current from the probe 8 to be maintained within a preselected range of values which corresponds to a preselected density of charge in the steam flow. The charge density should be preselected by conducting a test wherein different voltages are applied to the electrodes 4 with manual control of the power supply 7, and current from the probe 8 and the power generated by the generating unit are recorded to identify the setting which gives the largest power output, all else in the generating unit remaining constant Then the process controller 9 should be set to maintain the current from the probe 8 at approximately the value which corresponds to the maximum power output. The value of current from the probe desired and preselected will generally be about zero, which corresponds to approximately zero net charge in the steam flow just downstream of the electrodes, but in some cases a value of net charge density different from zero may be preselected; for example, a small positive net charge may be preselected to decrease corrosion.

Depending on the design of the exhaust hood and the turbine last stage, different design options for arranging and installing the active electrodes are possible. Below there are given two design options of devices for neutralizing charges in a steam flow, which were tested by the authors in a turbine unit and proved their high efficiency.

Two embodiments of a device for controlling flow charge were assembled and tested. Both embodiments were installed downstream the turbine last stage in the exhaust hood of the turbine type BK-SO at the District Power Generating Plant-2 (Eskhar) in Ukraine. A preferred embodiment of the device comprises the spider-web collector depicted in FIG. 3 made of woven stainless steel cable, and provided with the control electronics and insulators described in Example 1 and depicted in FIGS. 1 and 2.

EXAMPLE 1

The embodiment of the device for controlling the flow charge depicted in FIG. 1 was assembled and tested in the type BK-50 turbine at the Eskhar Power Station. The collector comprised six long active electrodes 4 installed between the walls of exhaust hood 1 and six short electrodes installed between the wall of the turbine bearing housing 6 and the wall of the exhaust hood 1. All the electrodes were electrically interconnected into two groups to allow for independent voltage supply to groups of electrodes located above the turbine axis and below it The electrodes may also be interconnected causing them to operate at the same voltage; in fact, the data in Table 1 below were collected with the electrodes interconnected as one group. The active electrodes 4 were placed at a distance of 150 to 170 mm from the rotor wheel surface and with a pitch of 170 to 250 mm, as much as the hood design could allow. In most generating units, a pitch within the range 100 to 300 mm will be most beneficial, and the pitch should be between one and two times as large as the distance of the active electrodes from the outer surface of the last stage rotor wheel. Each active electrode 4 was stretched between two suspension insulators 2. One of the insulators was attached to spring 3 which provided the correct tension for the electrode and helped damp-out vibration. The electrodes were made of a 3 mm diameter woven stainless steel cable.

The suspension insulator design is shown in FIG. 2. The insulators comprised 8 mm diameter glass-fiber rods 21 with stainless steel end caps 22 crimped on to either end and covered with silicone rubber insulation 23. The insulators attached to the wall of the exhaust hood 1 were 500 mm long, and the insulators attached to the wall of the turbine bearing housing 6 were 250 mm long. The outer diameter of the insulator body was 14 mm. Such insulators were rated for surface breakdown voltage of no less than 30 kV in the working medium. High voltage was fed from the high-voltage power source through the wall of the exhaust hood and to the active electrodes by means of a flexible current lead in the form of a copper wire coated with a layer of fluoroplastic insulator and encased in a solid fluoroplastic tube. The external diameter of the current lead was 12 mm. Such a solution ensured minimal leakage over the current lead. However, close to the turbine stage, especially in the zone of increased moisture, erosion of the fluoroplastic insulation and the copper cable was observed Therefore, in order to make a flexible current lead with an extended service life it is most practical to use an electrical cable insulated with silicone rubber. Such rubber has demonstrated high erosion resistance.

To monitor the flow charge an electric probe was used, which was designed as a 5 mm diameter metal rod 100 mm long and isolated from electrical ground. The probe was fitted on the hood tubular braces at the height of approximately 500 mm above the condenser upper tube bank. When testing, the active electrodes 4 were supplied with voltage from an adjustable direct current high-voltage power source and the short-circuit current flow between the electric probe lead and the ground terminal was measured. Table 1 shows the probe current value versus the voltage applied to the active electrodes.

TABLE 1

| U, kV | 0 | −5 | −10 | −15 |
|---|---|---|---|---|
| 1, $\mu$A | 0.07 | −0.01 | −0.01 | −0.07 |

From Table 1 it is clear that when the active electrodes were grounded (U=0) the flow charge density dropped, though it was not eliminated entirely. When negative voltage was applied to the electrodes (U=−5 kV to−10 kV) the probe current went to approximately zero, indicating approximately zero charge density in the flow. Thus, a voltage in the range −5 to −10 kV provides approximately zero net charge in this case. The voltage necessary to provide zero net charge in the flow may be different in other generating units with different configurations of the exhaust hood and different water chemistry. In most cases, the appropriate voltage will lie within the range −2 kV to −12 kv.

Several tests were conducted with the generating unit in stable operation with about 40 MW power output. When a voltage of about −10 kV was applied to the active electrodes shown in FIG. 1, with all other operating variables of the generating unit held constant, the power output increased by a few hundred kilowatts; that is, a power increase of about 1% at constant fuel rate was observed.

EXAMPLE 2

Another embodiment of the device is depicted in FIG. 3. In this particular example, the active electrodes include six full-length radial electrode elements 14, six half-length radial electrode elements 15, and two circumferential electrode elements 18 installed in a substantially coplanar array resembling a spider's web approximately 200 mm from the outer surface of the last stage rotor wheel 5. The various electrode elements were made of 1.2 mm diameter stainless steel wire, and were electrically interconnected. Woven stainless steel cable can also be used.

Each full length radial electrode element 14 was stretched between two suspension insulators 2. One insulator was secured to the wall of the turbine bearing housing 6 and the second one was attached to a spring 3 attached to the exhaust hood wall 1. The springs served as shock absorbing elements to dampen vibrations. Each of the two circumferential electrode elements 18 was attached to each of the six full-length radial electrode elements 14. Each of the six half-length radial electrode elements 15 was fastened at one end to a suspension, insulator 2 that was attached to exhaust hood wall 1 by spring 3, and to the circumferential electrode elements 18 at the other end. The half-length radial electrode elements 15 provide additional shaping and tensioning for the circumferential electrode elements 18. Using six half-length radial electrode elements 15 in place of an equal number of full-length radial electrode elements 14 decreased by half the number of suspension insulators attached to turbine bearing housing 6, thereby decreasing resistance to steam flow and the cost of the installation. The two circumferential electrode elements 18 are located adjacent to the periphery of the last stage turbine wheel where the density of charge to be removed is greatest. This spider web design for the active electrode ensures the most effective action on the zone with maximum charge density with minimal aerodynamic resistance. The active: electrode was connected to an adjustable high-voltage direct current power supply through flexible current lead 19 which also served as a feed-through insulator.

The length of the insulators was 200 mm and the external diameter was 12 mm. The surface breakdown voltage of such an insulator in the working medium is not less than 15 kV. Operation of the device was controlled using a long-wire type charge probe 10 installed in the exhaust hood exposed to the steam flow downs of the active electrode elements. The long-wire charge probe 10 comprised a 2 mm diameter stainless steel wire electrode 4 meters long, which was stretched between two suspension insulators 2 located 750 mm above the condenser tube bank and tensioned at one end by a spring.

The flow charge was controlled by measuring the short-circuit current from charge probe 10 to ground. The steam flow charge density was changed by varying the voltage applied to the active electrode. Table 2 shows the short-circuit current from charge probe 10 versus the voltage applied to the active electrode.

TABLE 2

| | | | | | | | | | | | | | |
|---|---|---|---|---|---|---|---|---|---|---|---|---|---|
| U, kV | 3.6 | 2 | 0.4 | 0 | −0.8 | −2 | −3.2 | −3.6 | −5.2 | −6 | −6.8 | −7.2 | −8.8 |
| I,μA | 75 | 34 | 15 | 11 | 6 | 4 | 0 | 0 | −2.5 | −6 | −15 | −25 | −60 |

From Table 2 it is evident that the device succeeded in changing the magnitude and even the polarity of the charge in the steam flow. Grounding the active electrode (U=0) did not provide full neutralization of the flow. With negative voltage (U=−3.2 to −3.6 kV) applied to the active electrode the flow charge density is equal to zero. Such voltage is insufficient to create a corona discharge, but flow neutralization is achieved due to the process described above. The tested device enabled not only neutralization but also control of the flow charge magnitude and polarity as well.

The ability to control electric charge in steam exiting a steam turbine by applying a large electric potential of the opposite polarity to electrodes properly disposed near to the last stage of the turbine has been demonstrated using two different active electrode designs, and the ability to increase the power generated thereby has also been demonstrated. While the foregoing description contains many specificities, these should not be construed as limitations on the scope of the invention, but rather as exemplifying specific embodiments of the invention.

Many variations are possible within the scope of the invention; for example, the design, number and exact disposition of active electrodes may be different from those described herein. In particular, the number of full-length radial electrode elements 14, half-length radial electrode elements 15, and circumferential electrode elements 18 comprising a collector of the spider-web kind may be different. Decreasing the number of full-length radial electrode elements 14 and substituting half-length radial electrode elements 15 for them would allow aerodynamic resistance to the steam flow to be decreased. An active electrode comprising several full-length radial electrode elements 14 with no half-length electrode elements 15 or circumferential electrode elements 18 could also be used.

Different kinds of suspension and feed-through insulators may be used, as long as they have sufficiently large breakdown voltage preferably no less than 15 kV) and useful service life in the flowing wet steam environment The use of electrodes to control charge in the steam flow may be combined with the electrochemical approaches described in U.S. patent application Ser. No. 09/037,902. The operation of the process may be controlled automatically using a process controller device as depicted in FIG. 1, or manually, using a microammeter to measure probe current as depicted in FIG. 3. The electrodes may be made of different kinds of metallic string, wire, woven cable, etc., as described in U.S. Pat. No. 5,735,125.

The foregoing description, for purposes of explanation, used specific nomenclature to provide a thorough understanding of the invention. However, it will be apparent to one skilled in the art that the specific details are not required in order to practice the invention. In other instances, well known circuits and devices are shown in block diagram form in order to avoid unnecessary dictation from the underlying invention. Thus, the foregoing descriptions of specific embodiments of the present invention are presented for purposes of illustration and description. They are not intended to be exhaustive or to limit the invention to the precise forms disclosed, obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated It is intended that the scope of the invention be defined by the following claims and their equivalents.

What is claimed is:

1. A method of increasing the power generated by a steam turbine, said method comprising the steps of:

receiving, at a steam turbine final stage, a steam byproduct with an electrically charged component; and creating an electric field immediately proximate to said steam turbine final stage to substantially eliminate said electrically charged component from said steam byproduct and thereby reduce turbulence associated with said steam byproduct.

2. The method of claim 1 wherein said creating step includes the step of positioning a set of active electrodes immediately proximate to said steam turbine final stage.

3. The method of claim 2 wherein said creating step includes the step of positioning a set of active electrodes between 50 and 300 mm from said steam turbine final stage.

4. The method of claim 1 wherein said receiving step includes the step of receiving a steam byproduct with an electrically charged component of a first polarity and said creating step includes the step of creating an electric field with a second polarity opposite said first polarity.

5. The method of claim 1 wherein said receiving step includes the step of receiving a steam byproduct with an electrically charged component with byproduct lines of force in a first direction and said creating step includes the step of creating an electric field with created lines of force in a second direction opposite said first direction.

6. The method of claim 1 wherein said creating step includes the step of creating an electric field with a direct current voltage.

7. The method of claim 6 wherein said creating step includes the step of creating an electric field with a direct current voltage of between −2 to −12 kilovolts.

8. A steam turbine, comprising:

a final stage turbine wheel to eject a steam byproduct with an electrically charged component; and a set of active electrodes to create an electric field immediately proximate to said final stage turbine wheel, said set of active electrodes creating an electric field to substantially eliminate said electrically charged component from said steam byproduct and thereby reduce turbulence associated with said steam byproduct.

9. The apparatus of claim 8 wherein said set of active electrodes is positioned between 50 and 300 mm from said final stage turbine wheel.

10. The apparatus of claim 8 wherein said set of active electrodes generate an electric field with a polarity opposite the polarity of said electrically charged component of said steam byproduct.

11. The apparatus of claim 8 further comprising a direct current power supply connected to said set of active electrodes.

12. The apparatus of claim 11 further comprising a flexible high-voltage current lead connected between said direct current power supply and said set of active electrodes, said flexible high-voltage current lead including an electrical cable insulated with a material selected from the group consisting of: silicone rubber and fluoroplastic resins.

13. The apparatus of claim 11 wherein said direct current power supply applies a direct current voltage of between −2 to −12 kilovolts to said set of active electrodes.

14. The apparatus of claim 11 further comprising a charge probe adjacent to said set of active electrodes to create a measured voltage.

15. The apparatus of claim 14 further comprising a controller to alter a direct current voltage output from said direct current power supply in response to said measured voltage.

16. The apparatus of claim 8 wherein active electrodes of said set of active electrodes are separated from one another by a pitch that is between one and two times the distance between said final stage turbine wheel and said set of electrodes.

17. The apparatus of claim 8 further comprising a housing to support said active electrodes, a set of high-voltage suspension insulators electrically isolating said housing from said set of active electrodes.

18. The apparatus of claim 8 wherein said set of active electrodes are made from a material selected from the group consisting of: stainless steel wire and woven stainless steel cable.

* * * * *